United States Patent [19]

Wood

[11] Patent Number: 4,747,487

[45] Date of Patent: May 31, 1988

[54] END LOADED CARTON

[75] Inventor: Prentice J. Wood, Hapeville, Ga.

[73] Assignee: The Mead Corporation, Dayton, Ohio

[21] Appl. No.: 102,353

[22] Filed: Sep. 29, 1987

[51] Int. Cl.[4] ..... B65D 05/42; B65D 65/02

[52] U.S. Cl. ..... 206/429; 206/427; 229/40

[58] Field of Search ..... 206/427, 429, 434; 229/40

[56] References Cited

U.S. PATENT DOCUMENTS 4,582,199 4/1986 Schuster ..... 206/429 X

*Primary Examiner*—William Price

*Attorney, Agent, or Firm*—Rodgers & Rodgers

[57] ABSTRACT

An end loaded carton having top, bottom and side walls foldably adjoined to form a tubular structure is provided with closure structure for the lower portion of the ends of the tubular structure which includes a triangular corner panel hingedly connected with the lower part of each end edge of each side wall and having a crease line extending divergently upward from the lower corner to each side wall, a pair of closure panels foldably adjoined to said corner panel along said crease lines at each end of the carton and forming a closure structure for the lower part of each end of the carton, a bottom end panel foldably joined to each end edge of the bottom wall together with a connecting web panel foldably joined to the bottom edge of each closure panel and to each of the bottom end panels at each corner of the carton.

9 Claims, 2 Drawing Sheets

END LOADED CARTON

TECHNICAL FIELD

This invention relates to cartons for packaging a plurality of containers such as bottles or cans and which preferably is formed of paperboard.

BACKGROUND ART

European patent specification publication number 0,044,169 B1 discloses an end loaded carton for packaging a plurality of articles such as bottles or cans and is concerned with closure structure for the ends of the carton, the closure structure including closure flaps foldably adjoined to gusset panels which in turn are foldably joined to the end edges of the carton side walls and which extend the entire height of the carton side walls together with tuck-in straps extending between the upper edges of the closure flaps at each corner of the carton and to end closure panels foldably joined to the end edges of the top wall at each end of the carton.

SUMMARY

An end loaded carton having top, bottom and side walls foldably adjoined to form a tubular structure is provided with end closure means which includes a pair of triangular corner panels hingedly connected respectively with the lower parts of the end edges of the side walls at each corner of the carton and which is further defined by a crease line extending divergently upward from the lower corners of each side wall, together with a pair of closure panels foldably joined respectively to the corner panels along the crease lines and forming a closure structure for the lower part of each end of the carton, a bottom end panel foldably joined to each end edge of the bottom wall and a connecting web panel foldably joined to the bottom edge of each of said closure panels and to each of said bottom end panels at each corner of the carton.

BEST MODE OF CARRYING OUT THE INVENTION

Figure 1:
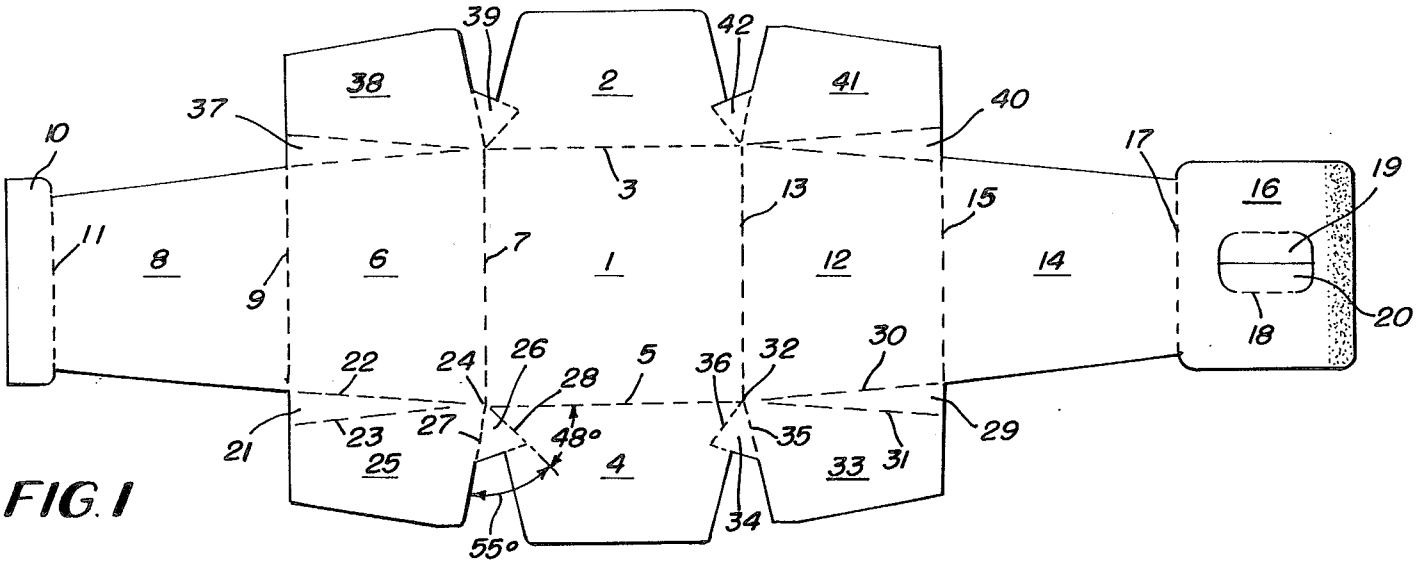
FIG. 1 is a plan view of a blank as viewed from the inside and which embodies the invention.

With reference primarily to FIG. 1, the numeral 1 designates the bottom wall of the carton. A bottom end panel 2 is foldably joined to an end edge of bottom wall 1 along fold line 3 while a bottom end panel 4 is foldably joined to the end edge of bottom wall 1 along fold line 5.

One side wall of the carton includes a lower portion 6 which is foldably joined to a side edge of bottom wall 1 along fold line 7 together with an upper portion 8 which is foldably joined to lower side wall portion 6 along fold line 9. A glue flap 10 is foldably joined to the upper portion 8 of one side wall along fold line 11.

The opposite side wall of the carton includes a lower portion 12 foldably joined to a side edge of bottom wall 1 along fold line 13 together with an upper portion 14 foldably joined to lower side wall portion 12 along fold line 15.

Top wall 16 is foldably joined to the upper portion 14 of one side wall along fold line 17 and includes hand gripping aperture 18 which includes finger gripping flaps 19 and 20 of well known construction.

Closure structure for the lower portion of one end of the carton includes corner flap 21 which is foldably joined to the lower portion 6 of one side wall along a fold line 22 and which includes a crease line 23 which extends divergently upward from the lower corner 24 of the carton. Closure panel 25 is foldably joined to corner panel 21 along fold line 23.

Connecting web 26 is foldably joined to the bottom edge of closure panel 25 along fold line 27 and to bottom end panel 4 along fold line 28. As is indicated on FIG. 1, fold lines 27 and 28 are disposed with respect to each other at an angle of approximately 55 degrees. Fold line 28 is disposed with respect to the end edge 5 of bottom wall 1 at an angle slightly in excess of 45 degrees and preferably at an angle of approximately 48 degrees as indicatd in FIG. 1.

On the opposite side of the carton, a corner panel 29 is foldably joined along fold line 30 to an end edge of the lower portion 12 of a side wall and a crease line 31 extends divergently upward from carton corner 32 and defines an edge of corner panel 29. A closure panel 33 is foldably joined to corner panel 29 along crease line 31.

A connecting web 34 is foldably joined to a side edge of closure panel 33 along fold line 35. Connecting web panel 34 is foldably joined to bottom end panel 4 along fold line 36. Fold lines 35 and 36 are angularly disposed with respect to each other by an angle of approximately 55 degrees and the fold line 36 is disposed with respect to the bottom end edge 5 of bottom wall 1 at an angle somewhat in excess of 45 degrees and which preferably is approximately 48 degrees.

The opposite end of the carton is closed by structure identical to that just described. This closure structure includes bottom end panel 2 together with corner panel 37 and closure panel 38 together with connecting web panel 39 as well as corner panel 40, closure panel 41 and connecting panel 42.

Figure 2:
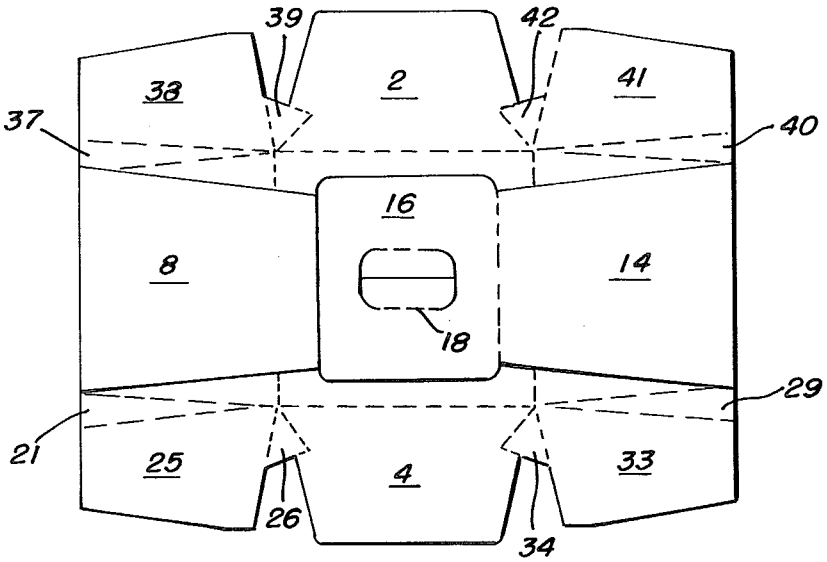
FIG. 2 is a view of the blank shown in FIG. 1 following a folding and gluing operation whereby the top, bottom and side walls are formed into a tubular structure when the collapsed arrangement of FIG. 2 is manipulated into set up condition.

In order to form the collapsed carton of FIG. 2 from the blank shown in plan view in FIG. 1, an application of glue is first made to the top wall 16 as indicated by stippling. Thereafter the upper portion 8 of one side wall is elevated and folded toward the right along fold line 9 while the upper portion 14 of the other side wall is elevated and folded to the left along fold line 15. This action causes the stippled adhesive on the top panel 16 to adhere to the glue flap 10. The blank then appears as shown in FIG. 2.

Figure 3:
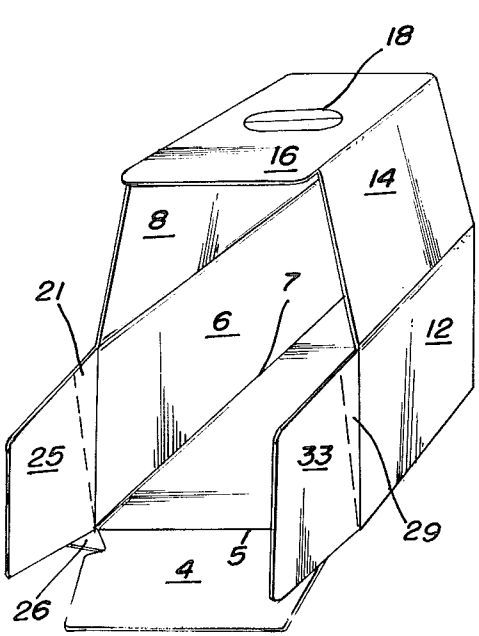
FIG. 3 is a view of the set up open ended carton ready for loading.

The collapsed carton as shown in FIG. 2 is set up ready for loading as shown in FIG. 3.

Figure 4:
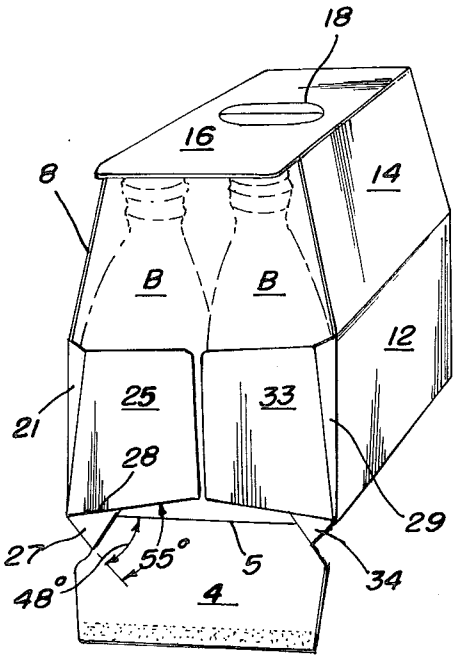
FIG. 4 is an end view similar to FIG. 3 following loading and during an intermediate stage of forming the closure structure for the lower portion of the end of the carton.

In FIG. 4 the articles B have been loaded through the end of the carton and bottom end panel 4 has been folded downwardly into approximately a vertical position. This action results in the disposition of fold line 28 slightly above fold line 5 as shown in FIG. 4 and swings the closure panel 25 together with the corner panel 21 into partially closed positions due to the action of connecting web 26 as shown in FIGS. 1 and 4. Connecting web 26 is foldably joined to bottom end panel 4 along fold line 28 which is arranged at an angle slightly in excess of 45 degrees to the end edge 5 of bottom wall 1. This action causes bending at fold line 22 and at crease line 23 so as to cause corner panel 21 and the associated closure panel 25 to move to initial positions astride the carton corners. Corner panel 29 and closure panel 33 are similarly manipulated by connecting web 34. An application of glue is made to bottom end panel 4 as indicated by stippling in FIG. 4.

Figure 5:
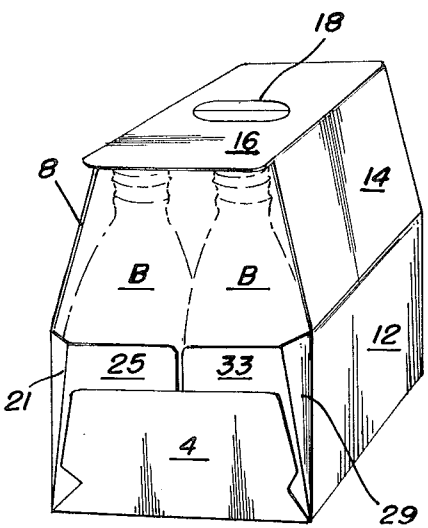
FIG. 5 is a view similar to FIGS. 3 and 4 but which shows the loaded carton with its end structure fully closed.

As shown in FIG. 5 bottom end panel 4 is then folded upwardly through an angle of approximately 180 degrees to cause the end closure panels 25 and 33 together with the corner panels 21 and 29 to shift to their final closed positions due to the towing in action attributable to the disposition of fold line 28 somewhat above fold line 5 so as to tighten the end closure structure substantially and to form an attractive closure for the end of the carton and to grip the articles such as bottles B in a secure manner. Bottom end panel 4 is secured to end closure panels 25 and 33 by the glue applied to bottom end panel 4.

I claim:

1. An end loaded carton for packaging a plurality of articles and comprising top, bottom and side walls foldably adjoined to form a tubular structure, an end closure for each end of said tubular structure each of which includes a pair of triangular corner panels hingedly connected respectively with the lower parts of the end edges of said side walls and further defined by a crease line extending divergently upward from the lower corner of each side wall, a pair of closure panels foldably adjoined respectively to said corner panels along said crease lines and forming a closure structure for the lower part of each end of the carton, a bottom end panel foldably joined to each end edge of said bottom wall, and a connecting web panel foldably joined to the bottom edge of each of said closure panels along a first fold line and to each of said bottom end panels along a second fold line at each corner of the carton.

2. An end loaded carton according to claim 1 wherein each of said web panels is of triangular configuration.

3. An end loaded carton according to claim 1 wherein said first and said second fold lines intersect at the bottom corner of the adjacent side wall.

4. An end loaded carton according to claim 1 wherein said first and said second fold lines are disposed at an angle of approximately fifty-five degrees to each other.

5. An end loading carton according to claim 1 wherein said second fold line is disposed at an angle somewhat in excess of forty-five degrees to the adjacent end edge of said bottom wall.

6. An end loading carton according to claim 5 wherein said second fold line is disposed at an angle of approximately forty-eight degrees to said adjacent end edge of said bottom wall.

7. An end loading carton according to claim 1 wherein each of said bottom end panels is bonded to the associated closure panels.

8. An end loading carton according to claim 1 wherein downward folding of each of said bottom end panels toward a vertical position following loading of the carton effects partial closing of the associated closure panels and bending of said crease lines and shifting of said corner panels to initial positions astride the carton corners thereby effecting a partial gripping action of the corner articles within the carton.

9. An end loading carton according to claim 1 wherein downward folding of each of said bottom end panels to a vertical position followed by upward folding through approximately one hundred eighty degrees of each of said bottom end panels moves said second fold line to a position slightly above the associated end edge of said bottom wall and effects a final towing in closing of said closure panels and a final shifting of said corner panels to final positions astride the carton corners thereby to tighten the carton about the end articles in the carton.

* * * * *